US006257998B1

(12) United States Patent
Ein-Gal

(10) Patent No.: US 6,257,998 B1
(45) **Date of Patent: *Jul. 10, 2001**

(54) FOOT PADDLE

(76) Inventor: Moshe Ein-Gal, 30 Azar Street, Ramat Hasharon, 47203 (IL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/337,921

(22) Filed: Jun. 22, 1999

(30) Foreign Application Priority Data

Jun. 22, 1998 (IL) ..... 125055

(51) Int. Cl.[7] ..... A63B 49/00

(52) U.S. Cl. ..... 473/518; 273/DIG. 18; 36/114; 36/133

(58) Field of Search ..... 473/518, 516, 473/527, 524; 273/DIG. 18; 36/136, 114, 132, 133

(56) References Cited

U.S. PATENT DOCUMENTS 1,637,278 * 7/1927 Renz ..... 273/DIG. 18 X
2,852,867 * 9/1958 Wagner et al. ..... 473/518 X
3,091,460 * 5/1963 Maldonado ..... 473/518
3,516,668 * 6/1970 Kirk ..... 473/518
3,628,794 * 12/1971 Conture ..... 273/DIG. 18 X
4,718,676 * 1/1988 Collins, Jr. ..... 273/DIG. 18 X
5,080,371 * 1/1992 Karczewshi ..... 273/DIG. 19 X
5,472,200 * 12/1995 Miller ..... 36/133 X

FOREIGN PATENT DOCUMENTS

3334142 * 4/1985 (DE) .
2691072 * 11/1993 (FR) .
2770412 * 5/1999 (FR) .

* cited by examiner

*Primary Examiner*—Raleigh W. Chiu
(74) *Attorney, Agent, or Firm*—Townsend and Townsend and Crew LLP

(57) ABSTRACT

A foot paddle including a footwear, a racket which includes a ball rebound surface bounded by a perimeter wall, the racket including a forefoot portion, configured to overlay a forefoot of the footwear and which generally does not extend medially beyond the forefoot of the footwear and does not extend outwards beyond a toe portion of the footwear, and a lateral portion which extends laterally beyond the footwear, and a mounting bracket mounted on the footwear, wherein the racket is attachable to the mounting bracket.

8 Claims, 4 Drawing Sheets

FOOT PADDLE

FIELD OF THE INVENTION

The present invention relates generally to paddle apparatus for toys, sport and entertainment, and particularly to a foot paddle which is secured to a foot of a user and which may be used to play paddle games in the style of tennis, squash, badminton and the like.

BACKGROUND OF THE INVENTION

Foot paddles are known which are strapped or otherwise secured to a foot of a user, and which can be used to play paddle games. The following U.S. patents are believed to be representative of the art: U.S. Pat. Nos. 3,091,460; 3,516,668; 3,628,794; 3,802,009; 3,823,494; 4,387,895; 4,718,676; and 5,080,371.

SUMMARY OF THE INVENTION

The present invention seeks to provide an improved foot paddle.

There is thus provided in accordance with a preferred embodiment of the present invention a foot paddle including a racket which includes a ball rebound surface bounded by a perimeter wall, the racket including a forefoot portion, configured to overlay a forefoot of a footwear and which generally does not extend medially beyond the forefoot of the footwear and does not extend outwards beyond a toe portion of the footwear, and a lateral portion which extends laterally beyond the footwear, and a mounting bracket mounted on the footwear, wherein the racket is attachable to the mounting bracket.

In accordance with a preferred embodiment of the present invention the mounting bracket includes a pair of brackets, one bracket being mounted on a medial side of the footwear and the other bracket being mounted on a lateral side of the footwear. Preferably the mounting bracket is attached to an outsole of the footwear. The mounting bracket may include a wire frame construction.

Further in accordance with a preferred embodiment of the present invention a mounting clip is attached to an underside of the forefoot portion of the racket, the mounting clip including a gripping portion which is securable to the mounting bracket. Preferably the gripping portion fixedly snaps on to the mounting bracket.

Still further in accordance with a preferred embodiment of the present invention a gripping strength of the gripping portion gripping the mounting bracket is such that the gripping portion detaches from the mounting bracket upon application of an external force to the foot paddle before such external force could inflict harm to a foot of a user of the foot paddle.

Additionally in accordance with a preferred embodiment of the present invention a shock absorber is mounted on a portion of the foot paddle and which is configured to abut a portion of the forefoot of the footwear.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
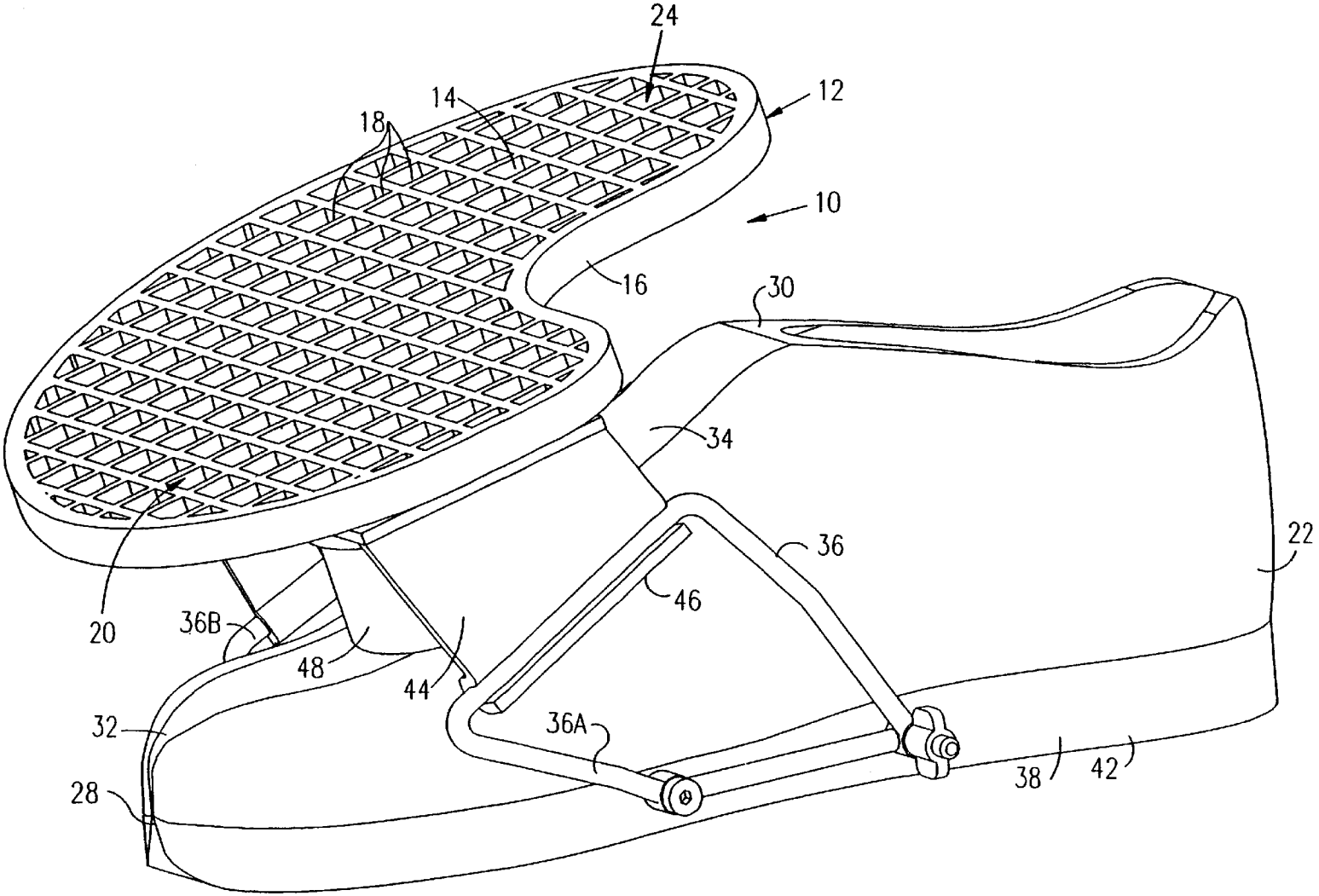
FIG. 1 is a simplified pictorial illustration of a foot paddle constructed and operative in accordance with a preferred embodiment of the present invention.

Reference is now made to FIGS. 1–4 which illustrate a foot paddle 10 constructed and operative in accordance with a preferred embodiment of the present invention. Foot paddle 10 preferably includes a racket 12 which includes a ball rebound surface 14 bounded by a perimeter wall 16. Ball rebound surface 14 and perimeter wall 16 are preferably constructed as one integral piece, such as by molding a thermoplastic material, for example. Alternatively, ball rebound surface 14 constructed separately and attached to perimeter wall 16. Ball rebound surface 14 is preferably constructed of a plurality of crossed rebound members 18, such as integrally molded plastic walls which cross each other generally at right angles, or alternatively, interlaced twine, cat gut or other string-type materials, such as traditionally used in tennis rackets.

Figure 4:
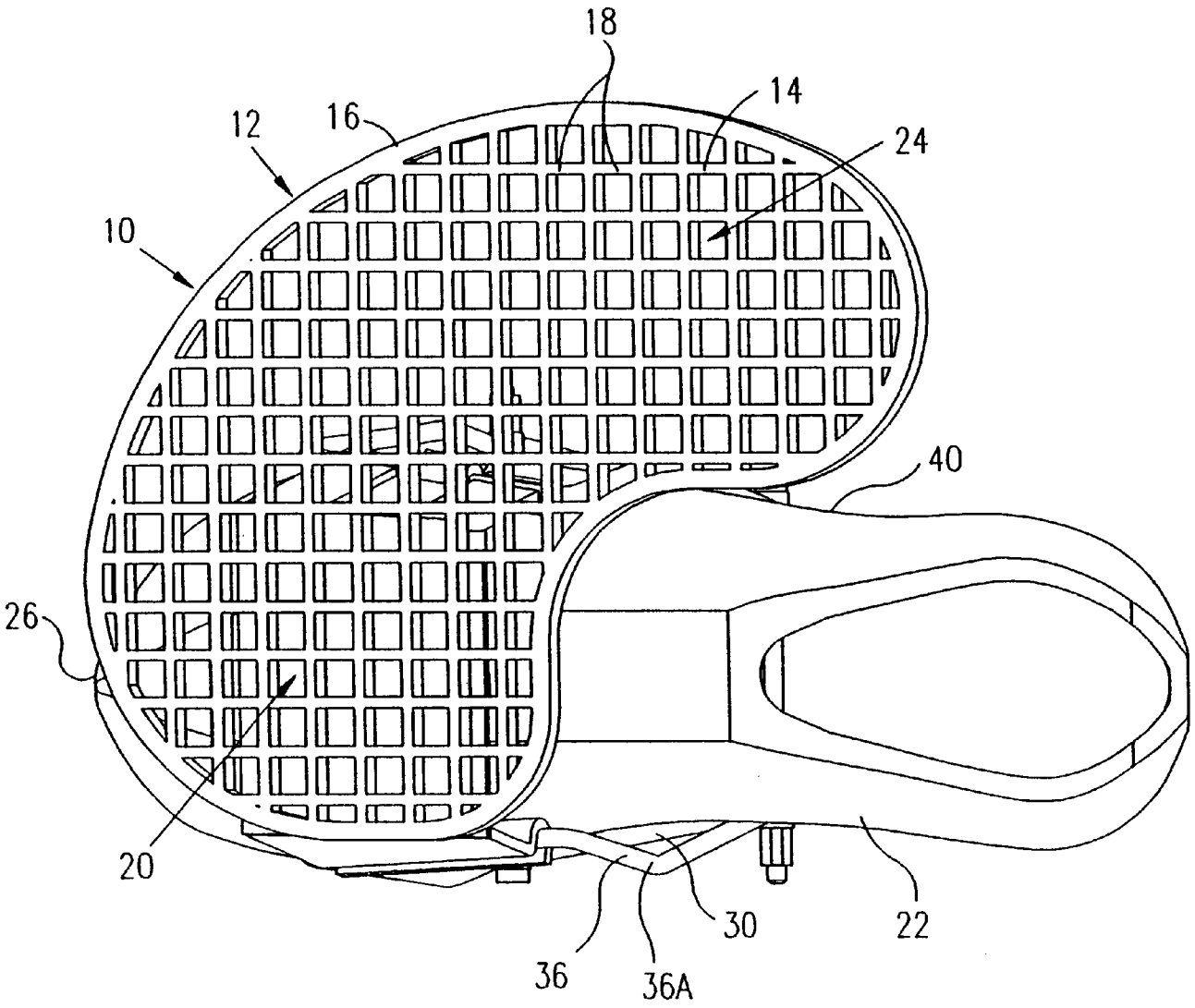
FIG. 4 is a simplified top-view illustration of the foot paddle of FIG. 1.

Racket 12 preferably has a shape generally like an artist's palette as best seen in FIGS. 1 and 4. As seen particularly in FIG. 4, racket 12 preferably includes a forefoot portion 20 which overlays a forefoot of a footwear 22 of a user and which preferably does not extend medially beyond the forefoot of footwear 22, so that a pair of foot paddles 10 so worn by the user will not bump, rub or otherwise interfere with each other during the course of play. Racket 12 preferably further includes a lateral portion 24 which extends laterally beyond footwear 22 so as to increase the area of ball rebound surface 14. Forefoot portion 20 of racket 12 preferably does not extend outwards beyond a toe portion 26 of footwear 22.

Footwear 22 may be any kind of footwear, such as sneakers, athletic shoes, running shoes, dress shoes, slippers and the like. The "forefoot of a footwear 22" is defined as that part of the footwear extending from a toe 28 to a posterior edge of a tongue 30, including a toe cap 32 and a vamp 34, as seen in FIG. 2.

Figure 2:
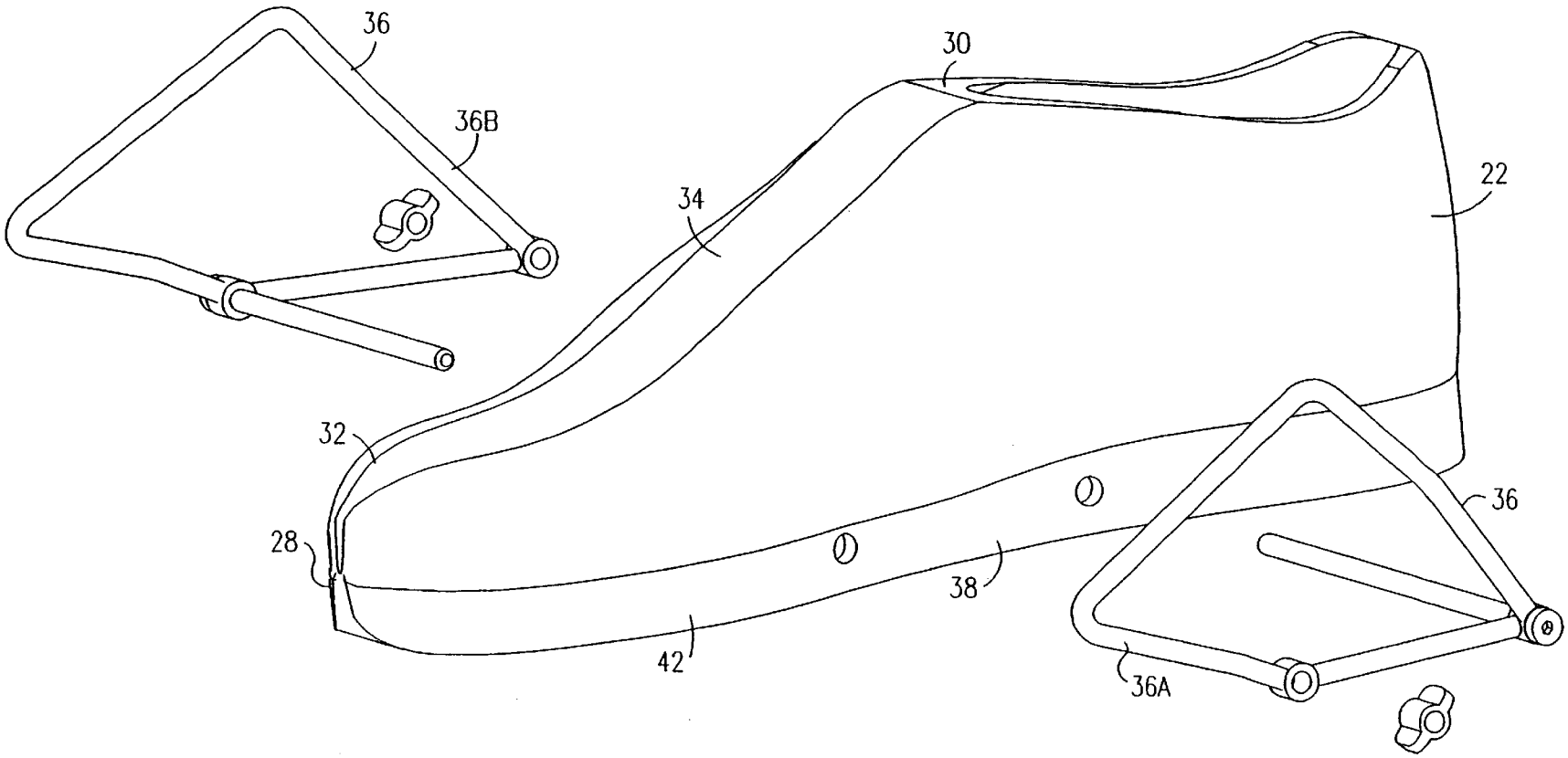
FIG. 2 is a simplified pictorial illustration of a mounting bracket for mounting the foot paddle of FIG. 1 on to footwear, in accordance with a preferred embodiment of the present invention.

As seen best in FIG. 2, a mounting bracket 36 is provided for mounting racket 12 on to footwear 22. Mounting bracket 36 preferably includes a pair of brackets 36A and 36B, which are mounted on a medial side 38 and a lateral side 40 (FIG. 4), respectively, of an outsole 42 of footwear 22. Brackets 36A and 36B may be secured to footwear 22 by means of any kind of suitable mechanical fasteners, such as wing nuts, for example. Brackets 36A and 36B are preferably of wire frame construction, although other constructions may also be employed.

Figure 3:
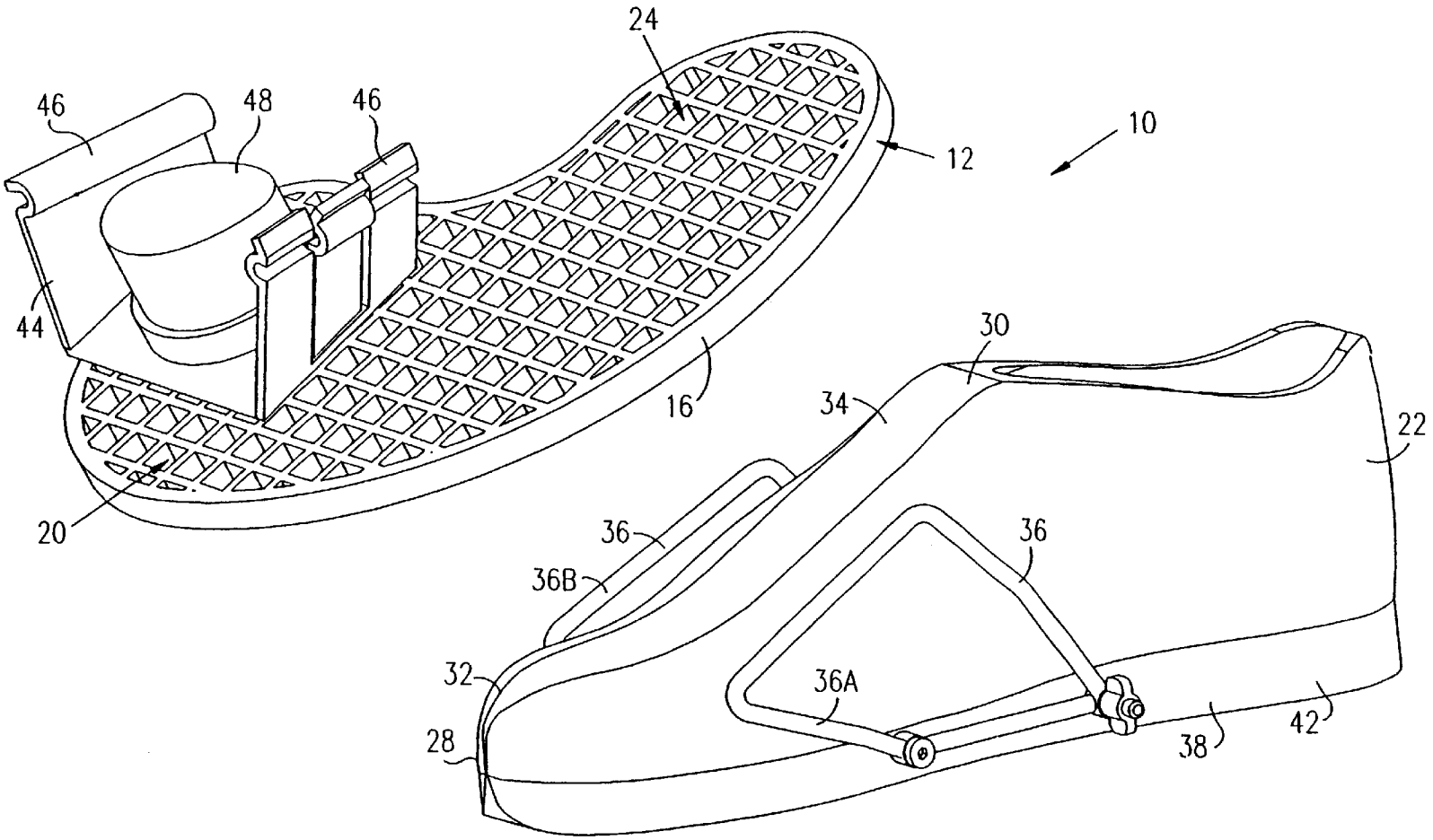
FIG. 3 is a simplified pictorial illustration of the foot paddle of FIG. 1 prior to mounting on the mounting bracket.

As seen best in FIG. 3, a mounting clip 44 is attached to an underside of forefoot portion 20 of racket 12. Mounting clip 44 includes a gripping portion 46 which is securable to a mounting bracket 36. In the illustrated embodiment, there are two gripping portions 46 which fixedly snap on to mounting brackets 36A and 36B. The gripping strength of gripping portions 46 with mounting brackets 36A and 36B is preferably such that gripping portions 46 detach from mounting brackets 36A and 36B upon application of an external force to foot paddle 10 before such external force could inflict harm to the foot of the user, in a similar fashion to ski boot straps.

Mounting clip 44 also preferably includes a shock absorber 48 which is configured to abut vamp 34 or any other portion of forefoot of footwear 22, and absorbs the shock of a ball impacting racket 12. Shock absorber 48 may be constructed of any elastomeric material, such as rubber or neoprene, or of a plastic foam, for example.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A foot paddle comprising:

a footwear;

a racket which comprises a ball rebound surface bounded by a perimeter wall, said racket comprising a forefoot portion, configured to overlay a forefoot of said footwear and which generally does not extend medially beyond the forefoot of the footwear and does not extend outwards beyond a toe portion of the footwear, and a lateral portion which extends laterally beyond the footwear; and a mounting bracket mounted on the footwear, wherein said racket is attachable to said mounting bracket.

2. The foot paddle according to claim 1 and wherein said mounting bracket comprises a pair of brackets, one bracket being mounted on a medial side of the footwear and the other bracket being mounted on a lateral side of the footwear.

3. The foot paddle according to claim 1 wherein said mounting bracket is attached to an outsole of the footwear.

4. The foot paddle according to claim 1 and wherein said mounting bracket comprises a wire frame construction.

5. The foot paddle according to claim 1 wherein a mounting clip is attached to an underside of the forefoot portion of said racket, said mounting clip comprising a gripping portion which is securable to said mounting bracket.

6. The foot paddle according to claim 5 wherein said gripping portion fixedly snaps on to said mounting bracket.

7. The foot paddle according to claim 5 wherein a gripping strength of said gripping portion gripping said mounting bracket is such that said gripping portion detaches from said mounting bracket upon application of an external force to said foot paddle before such external force could inflict harm to a foot of a user of said foot paddle.

8. The foot paddle according to claim 1 and further comprising a shock absorber mounted on a portion of said foot paddle and which is configured to abut a portion of the forefoot of said footwear.

* * * * *